US009950885B2

(12) United States Patent
Mizuguchi

(10) Patent No.: US 9,950,885 B2
(45) Date of Patent: Apr. 24, 2018

(54) IMAGE FORMING APPARATUS

(71) Applicant: CANON KABUSHIKI KAISHA, Tokyo (JP)

(72) Inventor: Kohei Mizuguchi, Joso (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/988,301

(22) Filed: Jan. 5, 2016

(65) Prior Publication Data

US 2016/0194167 A1 Jul. 7, 2016

(30) Foreign Application Priority Data

Jan. 7, 2015 (JP) ..... 2015-001377

(51) Int. Cl.
*B65H 5/00* (2006.01)
*B65H 5/36* (2006.01)
*B65H 29/52* (2006.01)

(52) U.S. Cl.
CPC ..... *B65H 5/36* (2013.01); *B65H 29/52* (2013.01); *B65H 2404/6111* (2013.01); *B65H 2405/141* (2013.01); *B65H 2601/255* (2013.01); *B65H 2701/1322* (2013.01); *B65H 2701/1916* (2013.01); *B65H 2801/27* (2013.01)

(58) Field of Classification Search
CPC ..... B65H 2405/141; B65H 2701/1916; B65H 29/52
See application file for complete search history.

(56) References Cited

U.S. PATENT DOCUMENTS 4,217,093 A * 8/1980 Steinlehner ..... G03G 15/2014 219/216
5,130,752 A * 7/1992 Morishita ..... G03G 15/6532 399/315

(Continued)

FOREIGN PATENT DOCUMENTS

CN 1490233 A 4/2004
CN 101515142 A 8/2009

(Continued)

OTHER PUBLICATIONS

Chinese Office Action issued in corresponding Chinese Application No. 201610006990.9 dated Mar. 27, 2017.

*Primary Examiner* — Howard J Sanders
(74) *Attorney, Agent, or Firm* — Fitzpatrick, Cella, Harper & Scinto

(57) ABSTRACT

An image forming apparatus includes an image forming portion forming an image on an envelope having a flap, and a guide portion composing a sheet conveyance path through which the envelope is conveyed and having a plurality of ribs projecting from a base plane thereof to the sheet conveyance path. Each of the plurality of ribs is disposed aslant such that a downstream end thereof in a sheet conveying direction is located at a widthwise side end more than an upstream end thereof and includes an inclined surface inclined with respect to a base plane on a side surface upstream in the sheet conveying direction of the ribs. The inclined surface is formed such that $0° < \theta a \leq 45°$ holds, where $\theta a$ denotes an inclination angle of the inclined surface with respect to the base plane in the sheet conveying direction.

13 Claims, 7 Drawing Sheets

(56) References Cited

U.S. PATENT DOCUMENTS

| | | | | |
|---|---|---|---|---|
| 6,169,875 | B1 * | 1/2001 | Tidrick | B65H 5/38 399/400 |
| 8,351,839 | B2 * | 1/2013 | Matsumoto | B65H 5/36 399/361 |
| 2005/0196216 | A1 * | 9/2005 | Tanahashi | B65H 3/0684 400/625 |
| 2006/0071417 | A1 * | 4/2006 | Baba | B65H 5/38 271/264 |
| 2014/0376949 | A1 * | 12/2014 | Fujita | G03G 21/206 399/92 |

FOREIGN PATENT DOCUMENTS

| | | | |
|---|---|---|---|
| CN | 101581894 | A | 11/2009 |
| CN | 102555531 | A | 7/2012 |
| CN | 102730466 | A | 10/2012 |
| CN | 103336417 | A | 10/2013 |
| JP | 2001-322735 | A | 11/2001 |
| JP | 2010-195544 | A | 9/2010 |
| JP | 2011-241022 | A | 12/2011 |

* cited by examiner

IMAGE FORMING APPARATUS

BACKGROUND OF THE INVENTION

Field of the Invention

The present invention relates to an image forming apparatus and more specifically to an image forming apparatus arranged to form an image on an envelope.

Description of the Related Art

Hitherto, an electro-photographic image forming apparatus such as a printer, a facsimile, a copier, and a multi-function printer having functions of the apparatuses described above is configured to form an electrostatic latent image on an image bearing member and to develop the latent image by using toner to form a toner image at first in forming an image on a sheet. Then, the toner image is transferred onto the sheet by means of electrostatic force and the transferred toner image is fixed to the sheet by applying heat and pressure to the toner image on the sheet. The sheet on which the toner image has been fixed is discharged out of the apparatus by a sheet discharge roller. It is noted that in a case in which images are to be formed on both surfaces of the sheet, the sheet on which the image has been formed on a first surface thereof is fed again by a reverse mechanism to the image forming portion through a duplex conveying path. Then, after transferring a toner image on a second surface of the sheet, the toner image is fixed by a fixing unit and then the sheet on which the images have been formed on the both surfaces thereof is discharged out of the apparatus.

By the way, there is a case when the sheet that has passed through the fixing unit causes curl by receiving heat. The curl grows largely in particular at a downstream edge in a sheet conveying direction at both widthwise edge corners orthogonal to the sheet conveying direction. Then, if the curl occurs, there is a possibility that the sheet is caught by a sheet conveyance guide and ribs provided on the sheet conveyance guide, causing corner folding and jamming.

Then, in order to smoothly convey a sheet whose curl on both corners is large, there is proposed an arrangement in which a plurality of ribs provided on a sheet conveyance guide to smoothly convey such sheet is disposed aslant into a fan form, a closure side of the fan form is positioned upstream in an approach direction, and a slope is provided on a rib side surface as disclosed in Japanese Patent Application Laid-open No. 2001-322735.

By the way, there is a case of forming an image on an envelope including an enclosing port and a flap closing the enclosing port as one example of the sheet by the conventional image forming apparatus. Then, there is also a case when the flap is folded such that the flap is located at one widthwise side of the envelope in conveying the envelope to an image forming portion.

In this case, the folded flap is not completely flattened and is kept opened more or less. Due to that, even if the plurality of ribs are disposed aslant into the fan form and the slope is provided on the side surface of the rib, there is a case when the flap is caught and thus causes corner folding, depending on an angle of the slope.

SUMMARY OF THE INVENTION

According to a first aspect of the invention, an image forming portion forming an image on an envelope having a flap; a guide portion composing a sheet conveyance path through which the envelope is conveyed and including a plurality of ribs projecting from a base plane to the sheet conveyance path; wherein, each of the plurality of ribs is disposed aslant such that a downstream end thereof in a sheet conveying direction is located on an outer side in a width direction orthogonal to the sheet conveying direction than an upstream end thereof in the sheet conveying direction and includes an inclined surface provided on a side surface, on an upstream side in the sheet conveying direction, of the rib and inclined with respect to the base plane, and wherein $0° < \theta a \leq 45°$ holds, where $\theta a$ denotes an inclination angle of the inclined surface with respect to the base plane in the sheet conveying direction.

According to a second aspect of the invention, an image forming apparatus includes an image forming portion forming an image on an envelope having a flap; and a guide portion composing a sheet conveyance path through which the envelope is conveyed, including a plurality of ribs projecting from a base plane to the sheet conveyance path; wherein the plurality of ribs are disposed aslant such that a downstream end thereof in a sheet conveying direction is located on side end side in a width direction orthogonal to the sheet conveying direction more than an upstream end thereof in the sheet conveying direction, and include an inclined surface on a side surface of on an upstream side in the sheet conveying direction of each of the plurality of ribs, and wherein the inclined surface is formed such that a relationship of $0° < \theta a \leq 45°$ and $\theta f + \theta b < 90°$ holds among an inclination angle $\theta a$ with respect to the base plane of the guide portion in the sheet conveying direction, an inclination angle $\theta b$ with respect to the base plane in the width direction, and a flap folding angle $\theta f$ of the envelope whose maximum value is an angle when a folding end of the flap is in contact with the base plane from which the rib is formed.

Further features of the present invention will become apparent from the following description of exemplary embodiments with reference to the attached drawings.

DESCRIPTION OF THE EMBODIMENTS

Figure 1:
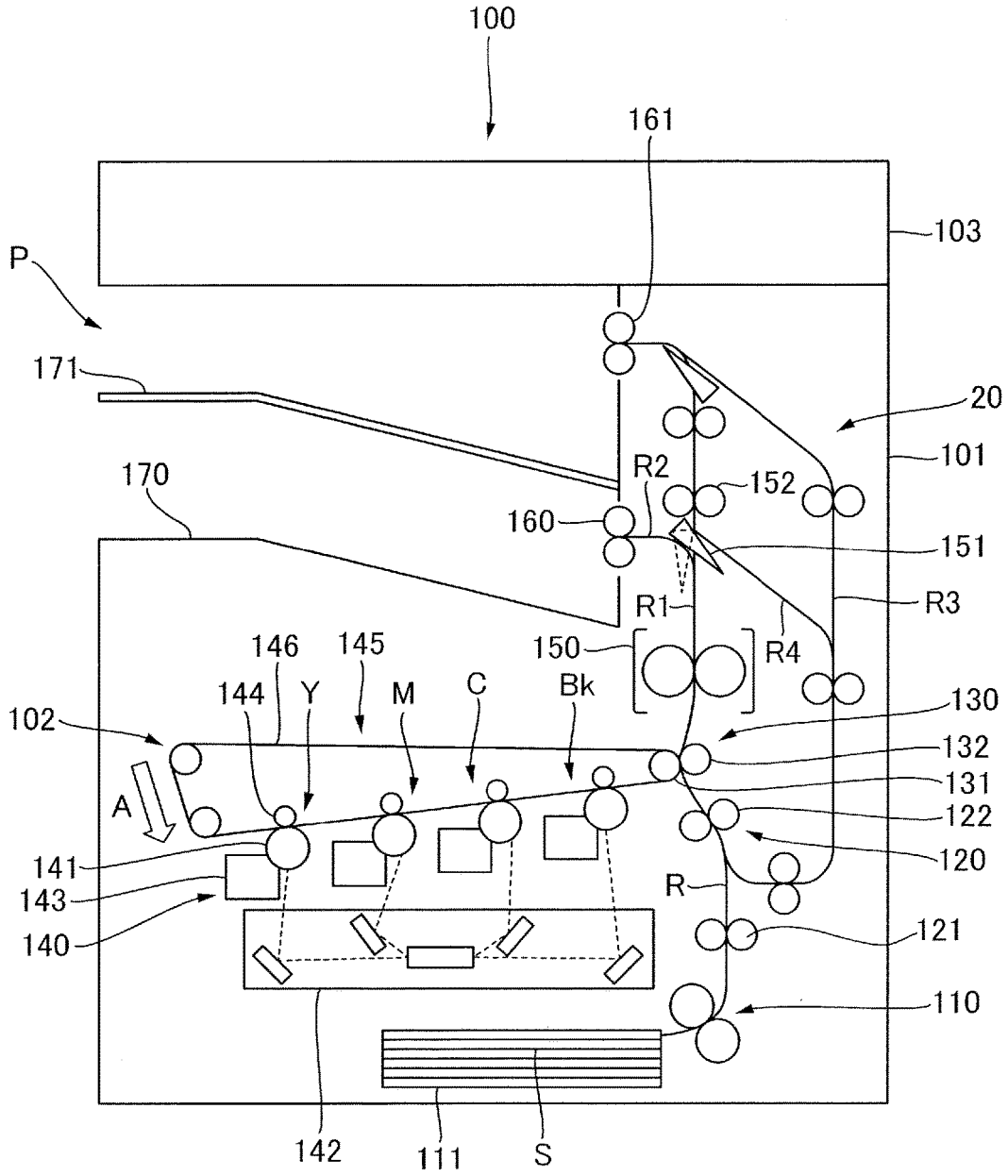
FIG. 1 is a schematic diagram illustrating a configuration of a laser beam printer which is one example of an image forming apparatus of an embodiment.

A mode for carrying out the invention will be described in detail below with reference to the drawings. FIG. 1 is a schematic diagram illustrating a configuration of a laser beam printer which is one example of an image forming apparatus of the embodiment of the invention. As shown in FIG. 1, the laser beam printer (referred to simply as a 'printer' hereinafter) 100 includes a printer body 101, i.e., a body of the image forming apparatus, and the printer body 101 includes an image forming portion 102 forming an image on a sheet. Provided substantially horizontally above the printer body 101 is an image reading unit 103. A sheet discharge space P is formed between the image reading unit 103 and the printer body 101. It is noted that the printer body 101 further includes a sheet feeding unit 110 feeding the sheet S out of a sheet feed cassette 111, a reverse conveyance portion 20 conveying the sheet on which the image has been formed again to the image forming portion 102.

The image forming portion 102 includes four process cartridges 140 each including a scanner unit 142, a photosensitive drum 141, a developer 143, and others and respectively forming toner images of four colors of yellow (Y), magenta (M), cyan (C), and black (Bk). The image forming portion 102 also includes an intermediate transfer unit 145 disposed above the process cartridges 140.

The intermediate transfer unit 145 includes an intermediate transfer belt 146 wrapped around a secondary transfer inner roller 131 and others. The intermediate transfer unit 145 also includes primary transfer rollers 144 respectively provided within a loop of the intermediate transfer belt 146 and in contact with the intermediate transfer belt 146 at positions facing the photosensitive drums 141. Here, the intermediate transfer belt 146 is disposed so as to be contact with the respective photosensitive drums 141 and is driven by a driving unit not shown so as to rotate in a direction of an arrow A. Then, the respective toner images formed on the photosensitive drums 141 and having negative polarity are sequentially transferred and superimposed onto the intermediate transfer belt 146 by a positive transfer bias applied to the intermediate transfer belt 146 through the primary transfer rollers 144. Thereby, a full-color image is formed on the intermediate transfer belt 146.

It is noted that a secondary transfer roller 132 composing a secondary transfer portion 130 transferring the full-color image formed on the intermediate transfer belt 146 onto the sheet S is provided at a position facing the secondary transfer inner roller 131 of the intermediate transfer unit 145. Still further, a fixing unit 150 is disposed above the secondary transfer roller 132, and a first sheet discharging roller pair 160, i.e., a first sheet discharging portion, and a second sheet discharging roller pair 161, i.e., a second sheet discharging portion, are disposed downstream in the sheet conveying direction of the fixing unit 150.

It is noted that the printer body 101 also includes a first sheet conveying path R, a second sheet conveying path R1, and a re-conveying path R3. The first sheet conveying path R conveys a sheet fed from the sheet feeding unit 110 to the image forming portion 102. The second sheet conveying path R1 conveys the sheet on which an image has been formed by the image forming portion 102. The sheet discharging path R2 is branched from the second sheet conveying path R1, and the first sheet discharging roller pair 160 is disposed along the sheet discharging path R2. The re-conveying path R3 in the reverse conveyance portion 20 connects the first sheet conveying path R with the second sheet conveying path R1.

Next, an image forming operation of the printer 100 constructed as described above will be described. In response to a start of the image forming operation, a laser beam is irradiated from the scanner unit 142 based on image information transmitted from a personal computer or the like not shown at first. Then, a surface of the photosensitive drum 141 homogeneously charged with a predetermined polarity and potential is sequentially exposed by the laser beam to form an electrostatic latent image on the photosensitive drum 141. Subsequently, the electrostatic latent image is developed and visualized by toner. Then, the four color toner images of yellow (Y), magenta (M), cyan (C), and black (Bk) on the respectively photosensitive drums 141 are transferred onto the intermediate transfer belt 146 by the transfer bias applied to the primary transfer rollers 144 to form the full-color toner image on the intermediate transfer belt 146. It is noted that toner left on the photosensitive drum 141 is collected into a discharge toner container not shown by a cleaning portion not shown provided in each of the process cartridges 140.

In parallel with this toner image forming operation, the sheet S that has been stored in the sheet feed cassette 111 is delivered out by the sheet feeding unit 110. After that, the sheet S is conveyed by a conveying roller pair 121 to a skew correcting unit 120 so that a skew of the sheet S is corrected. Next, a conveying roller pair 122 provided in the skew correcting unit 120 rotates to convey the sheet S to the secondary transfer portion 130 such that a front end of the sheet S whose skew has been corrected is synchronized with a position of the full-color toner image on the intermediate transfer belt 146. Then, the full-color toner image is collectively transferred onto the sheet S by a secondary transfer bias applied to the secondary transfer roller 132 at the secondary transfer portion 130.

Next, the sheet S on which the full-color toner image has been transferred is conveyed to the fixing unit 150 to undergo heat and pressure to melt and mix the respective color toners and to fix the toner image on the sheet S as a full-color image. After that, the sheet S on which the toner image has been fixed is discharged onto a sheet discharge tray 170 provided at a bottom of the discharge space P by the first sheet discharging roller pair 160 provided along the sheet discharging path R2 for example.

It is noted that in the case of forming images on both surfaces of the sheet S, a switching member 151, i.e., a guide member, is moved from a second position indicated by a solid line guiding the sheet S to the first sheet discharging roller pair 160 to a first position indicated by a broken line guiding the sheet S to the reverse conveyance portion 20. Thereby, the sheet S on which the image has been formed on a first surface thereof reaches the second sheet discharging roller pair 161 provided along the second sheet conveying path R1. Then, the second sheet discharging roller pair 161 rotates reversely and the sheet S is conveyed to the reverse conveyance portion 20 in a condition of being reversed. After that, the sheet S is conveyed again to the secondary transfer portion 130 through the re-conveying path R3 provided in the reverse conveyance portion 20, and a toner image is formed on a second surface opposite to the first surface of the sheet S.

Then, the toner image is fixed again by the fixing unit 150, and the sheet S on which the images have been fixed on the both surfaces thereof is discharged onto the sheet discharge tray 170 by the first sheet discharging roller pair 160. Or, in a case when a number of sheets stacked on the sheet discharge tray 170 increases, the switching member 151 is moved to the first position to discharge the sheets onto the sheet discharge tray 171 provided in the discharge space P by the second sheet discharging roller pair 161.

It is noted that the printer body 101 also includes a duplex conveying path R4 connecting a halfway of the second sheet conveying path R1 with the re-conveying path R3. Then, in a case of re-conveying a small-size sheet S for example, the sheet S is conveyed to the duplex conveying path R4 by reversing the reverse conveying roller pair 152. After that, the sheet S is conveyed to the first sheet conveying path R through the re-conveying path R3.

Figure 2:
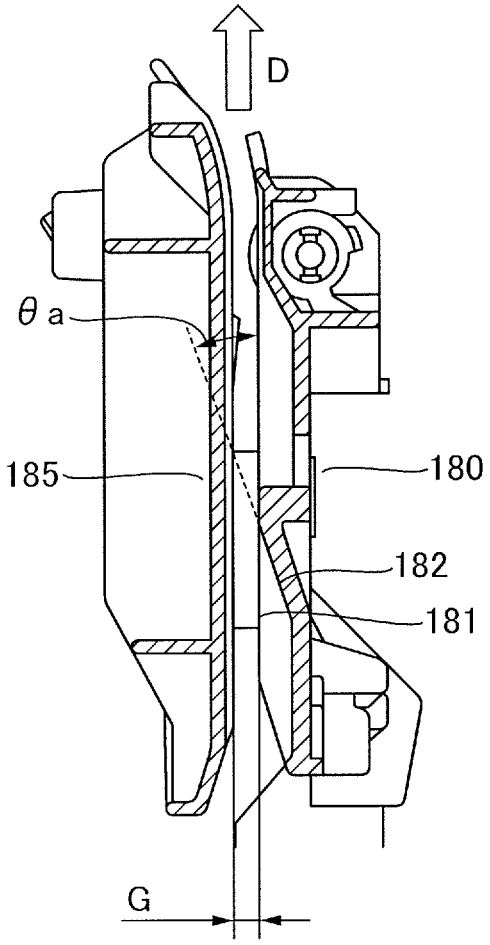
FIG. 2 illustrates an upstream part of a second sheet conveyance path provided in the laser beam printer.

FIG. 2 illustrates a structure of an upstream part of the second sheet conveying path R1 through which a sheet that has passed through the fixing unit 150 passes. As shown in FIG. 2, the upstream part of the second sheet conveying path R1 is composed of a slope conveyance guide 180, i.e., a guide portion, and a conveyance guide 185, i.e., a counter guide portion, disposed opposite to the slope conveyance guide 180 with a first conveyance guide gap G, i.e., a predetermined gap.

Figure 3A:
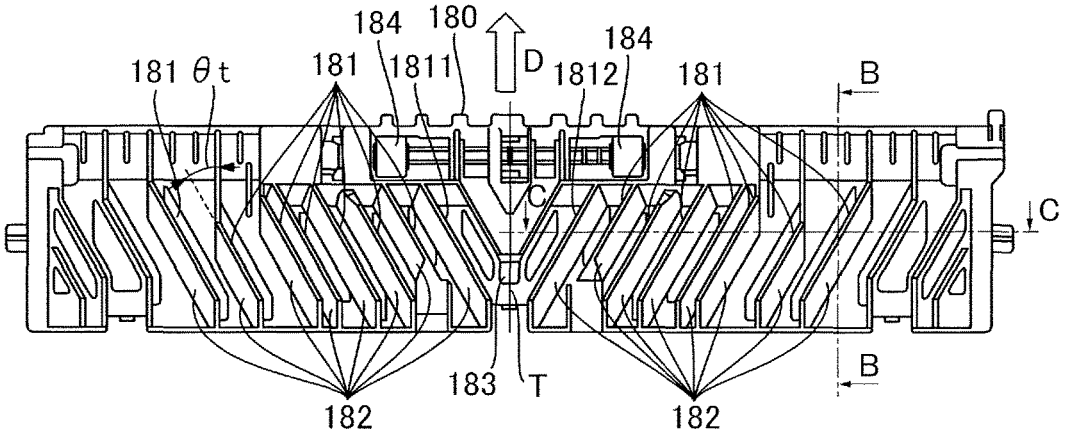
FIG. 3A illustrates a slope conveyance guide which is one of a conveyance guide pair composing the upstream part of the second sheet conveyance path.

As shown in FIG. 3A, the slope conveyance guide 180 is provided with a plurality of inclined ribs 181. The plurality of inclined ribs 181 are formed symmetrically centering on a center line T passing through a widthwise center part orthogonal to the sheet conveying direction and running in parallel with the sheet conveying direction and are inclined such that downstream ends thereof in the sheet conveying direction are located at widthwise side ends more than upstream ends thereof in the sheet conveying direction.

Still further, a slope 182, i.e., an inclined surface, is formed on a side surface upstream in the sheet conveying direction of each of the plurality of ribs 181. The slope 182 inclines such that the closer to the downstream in the sheet conveying direction from the upstream, the wider a widthwise distance between base end portions, respectively intersecting with a base plane 180*a*, of the inclined rib 181 and the slope 182 as shown in FIGS. 3A through 7. In other words, the closer to the downstream in the sheet conveying direction from the upstream, the longer the distance between base end portions, on a side of the base plane 180*a*, of the slope 182 and a surface on a widthwise opposite side of the slope 182 in the inclined rib 181. That is, the slope 182 is formed such that the closer to the downstream from the upstream in the sheet conveying direction, the smaller the inclination angle formed between the slope 182 and the base plane 180*a* becomes. It is noted that FIG. 2 is a section view taken along a line B-B in FIG. 3A and FIG. 4 is a section view of the slope conveyance guide taken along a line C-C in FIG. 3A.

It is possible to convey the sheet S while guiding by the inclined rib 181 in a condition in which both widthwise corners of a front end of the sheet S are gradually scooped up by the slope 182 by providing the slope 182 even if the both front corners of the sheet S are curled in passing through the fixing unit 150. It is possible to convey the sheet S smoothly without causing corner folding by providing the slope 182 on the inclined rib 181 as described above.

Figure 5A:
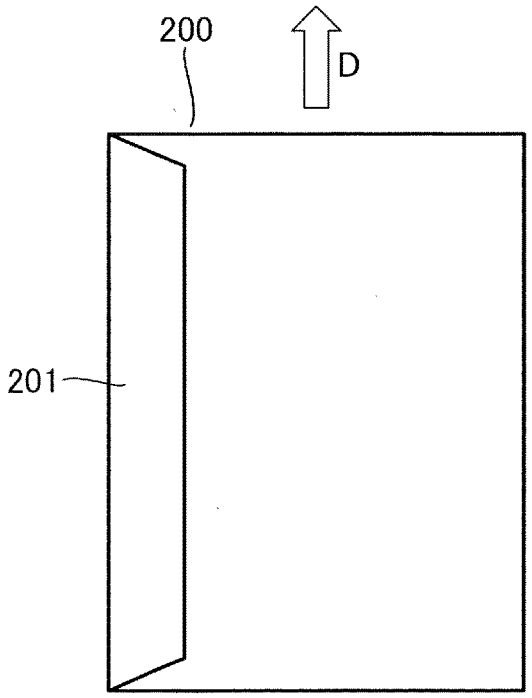
FIG. 5A is a plan view illustrating a state in which a flap of an envelope is folded.
Figure 5B:
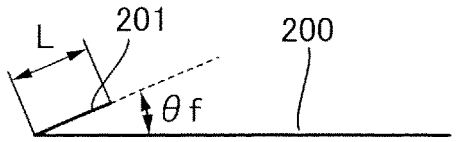
FIG. 5B is a diagram illustrating the envelope seen from an upstream side in a sheet conveying direction.

By the way, it is also possible to form an image not only on the normally cut sheet S but also on an envelope having an enclosing port and a flap for closing the enclosing port by the printer 100 of present embodiment. Here, in the case of forming an image on the envelope, the envelope 200 is stored in the sheet feed cassette 111 in a state in which the flap 201, folded so as to close the enclosing port, faces up and is positioned at one widthwise end side of the envelope 200 as shown in FIGS. 5A and 5B for example.

Then, when the envelope 200 which has been stored in such a state is conveyed to the image forming portion 102, the image is formed on a back surface of the envelope 200. Then, the envelope 200 passes through the fixing unit 150 and is guided to the second sheet conveying path R1 by the switching member 151. After that, the envelope 200 enters a first conveyance guide gap G formed by the slope conveyance guide 180 and the conveyance guide 185.

Here, the envelope 200 that has entered the first conveyance guide gap G is conveyed downstream while being guided by the inclined rib 181 of the slope conveyance guide 180 and a guide surface of the conveyance guide 185. However, it is unable to guide the envelope 200 by a non-inclined part of the inclined rib 181.

Figure 6A:
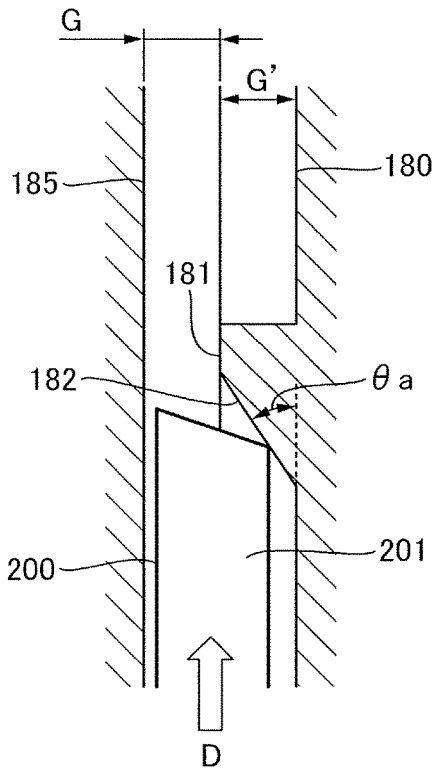
FIG. 6A is a schematic longitudinal section view illustrating a condition of the conveyance guide pair in passing through the envelope.
Figure 6B:
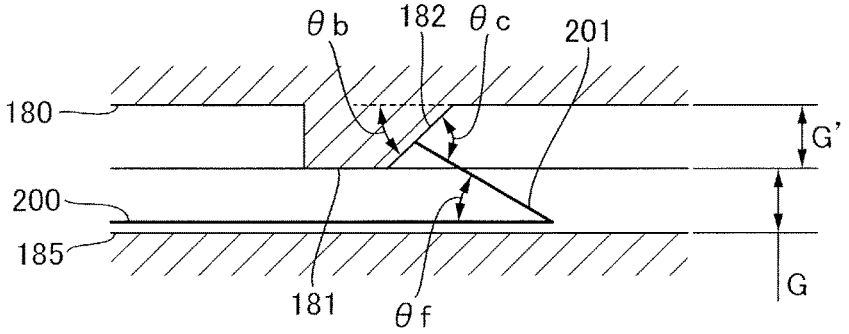
FIG. 6B is a schematic cross-sectional view illustrating the condition of the conveyance guide pair in passing through the envelope.

That is, the inclined rib 181 cannot guide the envelope 200 if the flap 201 being opened of the envelope 200 passes through the non-inclined part. Therefore, the flap 201 enters from a range of the first conveyance guide gap G to a range of a second conveyance guide gap G' as shown in FIGS. 6A and 6B and receives resistance by coming into contact with the slope 182 of the inclined rib 181. It is noted that FIG. 6A is a diagram illustrating a condition of the envelope 200 passing through the conveyance guide pair seen from a front side of the apparatus body and FIG. 6B is a diagram illustrating the condition of the envelope 200 passing through the conveyance guide pair seen from the upstream side in the sheet conveying direction.

Here, it is necessary to make an arrangement so that the front corners do not cause corner folding even if the flap 201 of the envelope 200 comes into contact with the slope 182 of the inclined rib 181. To that end, according to the present embodiment, a slope angle in the sheet conveying direction D of the slope 182 and a slope angle in a direction of height of the inclined rib 181 perpendicular to the sheet conveying direction D, through which the flap 201 passes, are set at angles which prevent the flap 201 from causing corner folding.

Next, the angles of the slopes preventing the flap 201 from causing the corner folding while conveying the envelope as described will be described. At first, the slope angle in the sheet conveying direction D of the slope 182 will be described with reference to FIG. 7A.

Figure 7A:
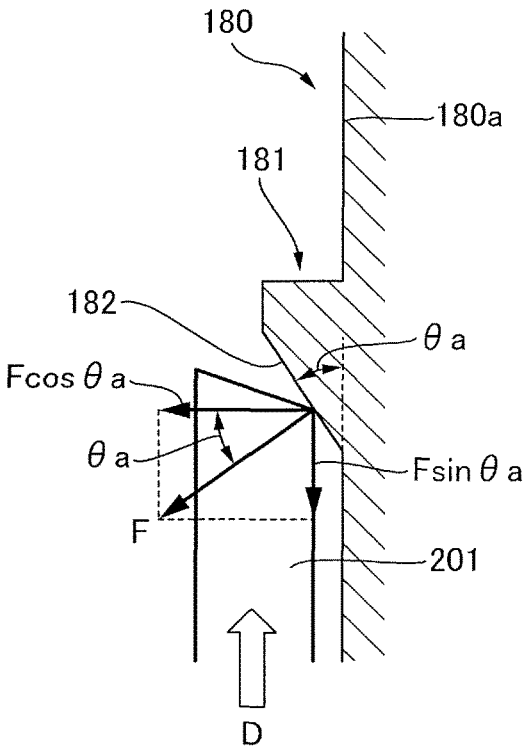
FIG. 7A is a schematic longitudinal section view illustrating a condition of a force acting on a flap when the envelope passes through the conveyance guide pair.

In FIG. 7A, F denotes a resistance acting on the front end of the flap 201 when the flap 201 comes into contact with the slope 182, $\theta a$ denotes the slope angle in the sheet conveying direction D, and F cos $\theta a$ and F sin $\theta a$ are component forces of the resistance F. Here, F cos $\theta a$ is a force generated by the front end of the flap 201 sliding along the slope 182 and acting to close the flap 201, and F sin $\theta a$ is a force disturbing the move of the flap 201.

Then, according to the present embodiment, the slope angle $\theta a$ in the sheet conveying direction D is set at an angle by which the resistance F acting on the front end of the flap 201 when the flap 201 comes into contact with the slope 182 acts such that the flap 201 runs up the slope 182, i.e., at $0° < \theta a \leq 45°$. Thereby, the front end of the flap 201 runs up along the slope 182 when the flap 201 comes into contact with the slope 182 of the inclined rib 181.

Figure 7B:
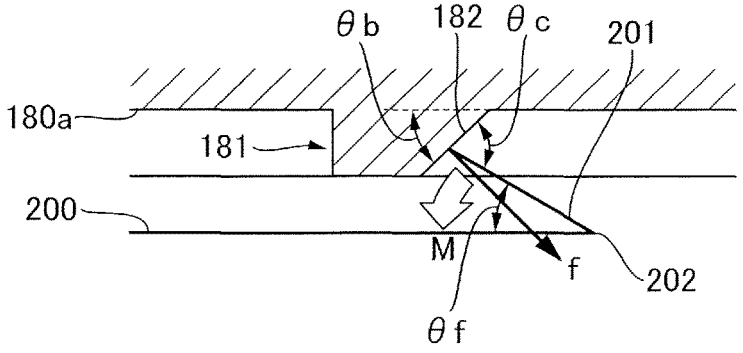
FIG. 7B is a schematic cross-sectional view illustrating the condition of the force acting on the flap when the envelope passes through the conveyance guide pair.

Next, the slope angle $\theta b$ in the direction of height of the rib of the slope 182 will be described with reference to FIG. 7B. In FIG. 7B, $\theta b$ denotes the slope angle in the rib height direction, f denotes a torque acting on the flap 201 when the front end of the flap 201 comes into contact with the slope 182, and M denotes a rotational moment at a fulcrum of a flap folding portion 202 generated by the torque f. $\theta c$ denotes a contact angle by which the flap 201 comes into contact with the slope 182.

Here, this contact angle $\theta c$ is equal to a composite angle of a flap folding angle $\theta f$ and the slope angle $\theta b$ in the direction perpendicular to the sheet conveying direction D. Then, according to the present embodiment, the composite angle $\theta c$ is set as $0 < \theta b \leq \theta c$ $(=\theta f + \theta b) < 90°$ such that the rotational moment M acts in a direction in which the flap 201 is folded centering on the flap folding portion 202.

By the way, a moment when the flap 201 opens most within the range of the slope 182 is a moment when the front end, i.e., distal end of the flap 201, of the flap 201 comes into contact with the base plane 180*a* from which the inclined rib 181 of the slope conveyance guide 180 is formed. A maximum value of the flap folding angle (θf), i.e., the folding angle of the flap 201, at this time can be calculated by $\theta f=\sin^{-1}(G0/L)$ from G+G'=G0, i.e., the first guide gap G, the second guide gap G' and a length L of a short direction of the flap 201. Then, the slope angle θb in the direction perpendicular to the sheet conveying direction D is set corresponding to the flap folding angle θf calculated as described above.

As described above, according to the present embodiment, the slope 182 is formed such that the following relationship holds, i.e., the slope angle θa in the sheet conveying direction D of the slope 182 is $0°<\theta a\leq 45°$ and the slope angle θb in the direction perpendicular to the sheet conveying direction D $\theta b\leq\theta c$ $(=\theta f+\theta b)<90°$.

It is noted that in the present embodiment, the slope angle θa in the sheet conveying direction D is set at 20° and the slope angle θb in the direction perpendicular to the sheet conveying direction D is set at 30°. It is noted that in the case when the slope angle θb is set at 30°, it is possible to guide the flap 201 without causing corner folding as long as the flap folding angle θf is within a range of 60°.

It is possible to smoothly guide the flap 201 and convey the envelope 200 in a state in which the flap 201 is not caught by the plurality of inclined ribs 181 and the slopes 182 provided in the slope conveyance guide 180 by setting the two slope angles θa and θb as described above. It is noted that the envelope 200 is conveyed by a conveying roller 184 provided downstream in the sheet conveying direction D of the slope conveyance guide 180 and is passed to the second sheet discharging roller pair 161 to be discharged out to the second sheet discharge tray 171.

By the way, according to the equation, $\theta f=\sin^{-1}[[G+G']/L]$, the flap folding angle θf decreases if the flap length L increases, so that it is possible to prevent the corner folding of the flap 201 even if the slope angle θb in the direction perpendicular to the sheet conveying direction D is set to be large more or less. Still further, because the flap folding angle θf decreases by reducing the first guide gap G, it is possible to prevent the corner folding of the flap 201 even if the slope angle θb in the direction perpendicular to the sheet conveying direction D is set to be large more or less.

As described above, according to the present embodiment, the slope conveyance guide 180 is provided with the plurality of inclined ribs 181 inclined from the center to the both widthwise ends, and the slope 182 is formed upstream in the sheet conveying direction D of each of the plurality of inclined ribs 181. Then, the slope 182 is formed such that the relationship of $0°<\theta a\leq 45°$ and $\theta b\leq\theta f+\theta b<90°$ holds among the slope angle θa in the sheet conveying direction D, the slope angle θb in the direction perpendicular to the sheet conveying direction D, and the flap folding angle θf of the envelope 200. That is, the flap folding angle θa with respect to the base plane 180*a* in the sheet conveying direction D of the slope 182 formed on the inclined rib 181 is set. Still further, the inclination angle θb in the rib height direction with respect to the flap folding angle θf of the flap 201 of the envelope 200 conveyed, i.e., the inclination angle θb with respect to the base plane 180*a* in the width direction is set. It is noted that the slope 182 is formed such that $\theta b<90°$ holds.

This arrangement makes it possible to prevent the flap 201 from causing corner folding even in a case when the flap 201 of the envelope 200 is folded and the envelope 200 is fed in a state in which the flap 201 is folded in a direction orthogonal to the sheet conveying direction D. Still further, this arrangement makes it possible to smoothly feed the sheet S normally cut without causing corner folding because the sheet S is guided and conveyed such that the front both corner parts of the sheet S are gradually scooped up.

It is noted that while no slope 182 is provided on the inclined rib 181 through which the flap 201 of the envelope 200 will not pass in the present embodiment, the slopes 182 may be provided on all inclined ribs 181. Still further, it is preferable to set not only the inclination angle of the slope 182 but also an inclined rib angle θt of the plurality of the inclined ribs 181 shown in FIG. 3A to be 45° or less so as to be able to guide the flap 201 smoothly.

By the way, there is a case when condensation is generated in the slope conveyance guide 180 due to vapors generated when the sheet S passes through the fixing unit 150. In this case, a defective image is causable due to the moisture adhering on the sheet S. Then, the conveyance ribs including the inclined ribs 181 provided in the slope conveyance guide 180 are set high by a certain degree in the present embodiment.

This arrangement makes it possible to cut the moisture adhering on the sheet S even if condensation is caused on the conveyance guide surface because the sheet S will not come into contact with a bottom surface of the slope conveyance guide 180 when the sheet S is guided by the conveyance ribs including the inclined ribs 181. It is also possible to prevent the defective image caused by the condensation by providing airflow holes. In this case, the sheet S will not be caught by the airflow holes by disposing the airflow holes adjacently on the downstream side in the sheet conveying direction D of the inclined ribs 181. It is then possible to steadily flow air smoothly within the printer body 101.

Figure 3B:
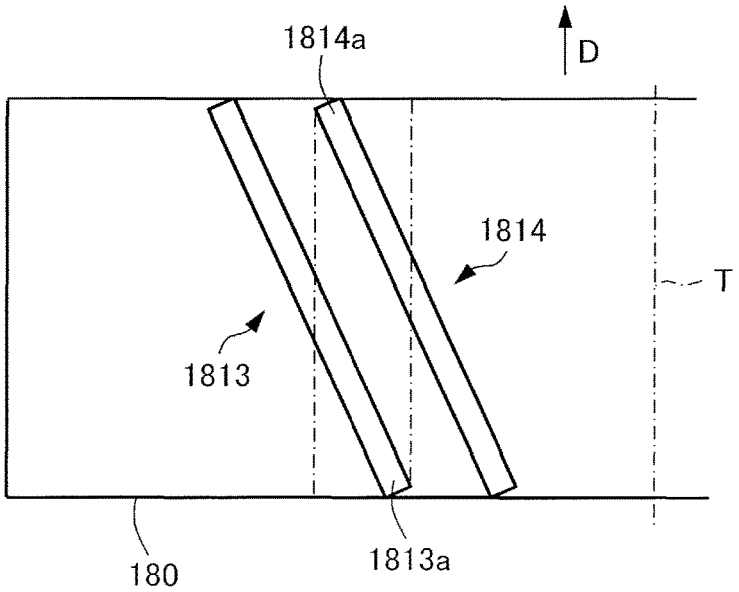
FIG. 3B illustrates a first rib and a second rib.
Figure 4:
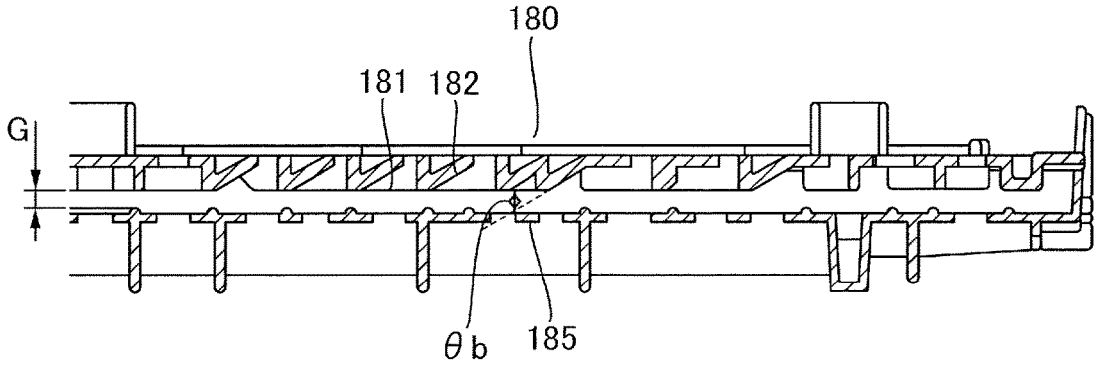
FIG. 4 is a section view of the slope conveyance guide taken along a line C-C in FIG. 3A.

Still further, according to the present embodiment, a widthwise position of the upstream end in the sheet conveying direction D of one of neighboring inclined ribs 181 is leaned toward the widthwise center more than a position of the downstream end in the sheet conveying direction of the other inclined ribs 181 on the widthwise center side as described in FIG. 3B. That is, the plurality of ribs includes a first rib 1813, and a second rib 1814 disposed on the widthwise center side more than the first rib 1813 and a whose widthwise position of the downstream end in the sheet conveying direction D is located widthwise outside more than a widthwise position of the upstream end in the sheet conveying direction D of the first rib 1813. Still further, a sheet supporting portion 183 is provided between two inclined ribs 1811 and 1812 whose neighboring inclination directions are different. It is noted that the sheet supporting portion 183 has a shape in which a widthwise length on a downstream side in the sheet conveying direction D is longer than that on an upstream side, symmetrical centering on the center line T, and has an upper surface part 183*a* as high as the inclined rib 181. Still further, slopes formed into the same shape with the slope 182 formed on the inclined rib 181 are formed on faces of the sheet supporting portion 183 facing the inclined ribs 1811 and 1812. That is, the slopes formed into the same shape with the slopes 182 of the inclined ribs 1811 and 1812 neighboring on the widthwise both sides are formed on the side surface parts the sheet supporting portion 183.

Then, the sheet S moves always in contact with any of the inclined ribs 181 or the upper surface part 183*a* of the sheet supporting portion 183 in passing through the slope conveyance guide 180 disposed in the vicinity of the downstream side of the fixing unit 150 by setting the height of the upper surface part 183*a* of the sheet supporting portion 183 to the same level with the inclined ribs 181. This arrangement makes it possible to disperse a load of the sheet S, to prevent a rib trace from being generated otherwise caused by eccentric application of the load of the sheet S on the inclined ribs 181, and to cut unevenness of the image otherwise formed on the sheet S when the sheet S passes through the slope conveyance guide 180. Still further, because the side surface part of the sheet supporting portion 183 includes the slopes formed into the same shape with the slopes 182 of the inclined ribs 1811 and 1812, it is possible to guide the envelope without causing corner folding of the flap otherwise caused by the sheet supporting portion 183.

It is noted that although the case in which the inclined ribs 181 and the slopes 182 are provided in the slope conveyance guide 180 has been described in the present embodiment, the present invention is not limited to the slope conveyance guide 180 and is applicable to any member as long as it is a guide member conveying an envelope.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-001377, filed Jan. 7, 2015 which is hereby incorporated by reference herein in its entirety.

What is claimed is:

1. An image forming apparatus, comprising:

an image forming portion configured to form an image on an envelope having a flap; and a guide portion configured to guide the envelope which is conveyed through a sheet conveyance path in a sheet conveying direction, the guide portion including a rib projecting to the sheet conveyance path, wherein the rib is positioned at an angle to the sheet conveying direction such that a first part of the rib is further outside in a width direction orthogonal to the sheet conveying direction than a second part of the rib which is located upstream of the first part of the rib in the sheet conveying direction, wherein the rib includes an inclined surface provided on a side surface of the rib, the side surface being on an upstream side in the sheet conveying direction and on an outer side in the width direction, the inclined surface being inclined, in a section perpendicular to the width direction, to approach a ridge of the rib toward downstream in the sheet conveying direction, and wherein the rib includes an inclined portion on its upstream end portion in the sheet conveying direction, the inclined portion being configured to extend from a base plane to an upstream end of the ridge of the rib and to incline toward downstream in the sheet conveying direction.

2. The image forming apparatus according to claim 1, wherein the ridge of the rib is formed of a flat surface arranged in parallel with the sheet conveying direction in the section perpendicular to the width direction.

3. The image forming apparatus according to claim 1, wherein the rib is one of a plurality of ribs, and wherein a widthwise position of an upstream end in the sheet conveying direction of one rib among two neighboring ribs is located at widthwise center side more than a position of a downstream end in the sheet conveying direction of the other rib located at the widthwise center side more than the one rib.

4. The image forming apparatus according to claim 1, wherein the rib is one of a plurality of ribs, and the ribs are provided symmetrically centering on a center line running in parallel with the sheet conveying direction and passing through a widthwise center part of the guide portion, the image forming apparatus further comprising a sheet supporting portion formed between two neighboring ribs whose inclination directions are different, having a shape whose widthwise length of an upstream side in the sheet conveying direction is longer than that of a downstream side and which is symmetrical centering on the center line, and having a same height with the rib.

5. The image forming apparatus according to claim 4, wherein an inclined surface having a same shape with the inclined surface formed on the rib is formed on side surfaces of the sheet supporting portion facing the two neighboring ribs whose inclination directions are different.

6. The image forming apparatus according to claim 1, wherein the inclined surface is formed such that the flap of the envelope conveyed with a folding line being in parallel to the sheet conveying direction receives a force from the inclined surface in a direction in which the flap is folded.

7. The image forming apparatus according to claim 1, wherein the inclined surface is continuously formed from a base plane to the ridge of the rib.

8. The image forming apparatus according to claim 1, wherein the rib is a first rib, and further comprising a second rib in a vicinity of the first rib, wherein the second rib is positioned at an angle to the sheet conveying direction such that a first part of the second rib is further outside in the width direction than a second part of the second rib which is located upstream of the first part of the second rib in the sheet conveying direction, wherein the second rib includes an inclined surface provided on a side surface of the rib, the side surface of the second rib being on an upstream side in the sheet conveying direction and on an outer side in the width direction, the inclined surface of the second rib being inclined, in a section perpendicular to the width direction, to approach a ridge of the second rib toward downstream in the sheet conveying direction, and wherein a part of the inclined surface of the first rib is disposed downstream, in the sheet conveying direction, of a part of the inclined surface of the second rib, and a position of the part of the inclined surface of the first rib in the width direction and a position of the part of the inclined surface of the second rib in the width direction correspond to each other.

9. The image forming apparatus according to claim 1, wherein $0° < \theta a \leq 45°$ holds, where $\theta a$ denotes an angle between the inclined surface and the sheet conveying direction in the section perpendicular to the width direction.

10. The image forming apparatus according to claim 9, wherein the inclined surface is formed such that a relationship of $0° < \theta a \leq 45°$ and $\theta f + \theta b < 90°$ holds where $\theta b$ denotes an angle between the inclined surface and the width direction in a section perpendicular to the sheet conveying direction, and $\theta f$ denotes a flap folding angle of the envelope whose maximum value is an angle when a distal end of the flap is in contact with the base plane from which the rib is formed.

11. The image forming apparatus according to claim 10, further comprising a counter guide portion provided so as to face the guide portion and composing the sheet conveyance path together with the guide portion, wherein maximum value of the flap folding angle θf is determined by a distance between the guide portion and the counter guide portion and a length in a short direction of the flap.

12. The image forming apparatus according to claim 9, wherein the ridge of the rib includes a straight portion in the section perpendicular to the width direction, and wherein the angle θa denotes an angle between the inclined surface and the straight portion being in parallel with the sheet conveying direction in the section perpendicular to the width direction.

13. The image forming apparatus according to claim 1, wherein the inclined portion of the rib is parallel to the inclined surface the rib in the section perpendicular to the width direction.

* * * * *